US010605430B2

(12) United States Patent
Catalano

(10) Patent No.: US 10,605,430 B2
(45) Date of Patent: Mar. 31, 2020

(54) LIGHT SOURCE FOR UNIFORM ILLUMINATION OF A SURFACE

(71) Applicant: Ledvance LLC, Wilmington, MA (US)

(72) Inventor: Anthony W. Catalano, Boulder, CO (US)

( * ) Notice: Subject to any disclaimer, the term of this patent is extended or adjusted under 35 U.S.C. 154(b) by 0 days.

(21) Appl. No.: 16/057,870

(22) Filed: Aug. 8, 2018

(65) Prior Publication Data

US 2018/0347784 A1 Dec. 6, 2018

Related U.S. Application Data

(63) Continuation of application No. 14/874,128, filed on Oct. 2, 2015, now Pat. No. 10,072,819.

(60) Provisional application No. 62/058,866, filed on Oct. 2, 2014.

(51) Int. Cl.

| | |
|---|---|
| ***F21V 7/08*** | (2006.01) |
| ***F21V 7/00*** | (2006.01) |
| ***F21V 7/04*** | (2006.01) |
| *F21S 8/04* | (2006.01) |
| *F21Y 103/10* | (2016.01) |
| *F21Y 115/10* | (2016.01) |

(52) U.S. Cl.

CPC ..... *F21V 7/005* (2013.01); *F21V 7/048* (2013.01); *F21V 7/08* (2013.01); *F21S 8/04* (2013.01); *F21V 7/0016* (2013.01); *F21Y 2103/10* (2016.08); *F21Y 2115/10* (2016.08)

(58) Field of Classification Search

CPC ..... F21V 7/0008; F21V 7/005; F21V 7/048; F21V 7/008; F21V 7/0016; F21V 7/0083; F21V 7/06; F21V 7/08; F21S 41/33; F21S 41/337

USPC ..... 362/223, 346, 347, 297, 307, 362/217.05–217.07

See application file for complete search history.

(56) References Cited

U.S. PATENT DOCUMENTS

| | | | | |
|---|---|---|---|---|
| 2,194,841 A * | 3/1940 | Welch | F21V 7/005 | 362/217.05 |
| 6,851,835 B2 * | 2/2005 | Smith | F21V 7/0008 | 362/305 |
| 2008/0247170 A1 * | 10/2008 | Peck | F21V 7/0008 | 362/297 |

* cited by examiner

*Primary Examiner* — Evan P Dzierzynski
*Assistant Examiner* — Keith G. Delahoussaye

(57) ABSTRACT

Devices and methods for uniform illumination of a target surface are disclosed. A device assembly has a light source configured to be coupled to a mounting surface, and at least one reflector. The reflector is configured to be coupled to at least one of the light source or the mounting surface, and interposed between the light source and the mounting surface, the reflector having a reflective surface area and a plurality of curved reflective segments. The reflector is shaped and arranged relative to the light source such that the reflector directly intercepts and reflects a portion of light emitted by the light source to the target surface to thereby cause substantially uniform illumination of the target surface. The target surface has a surface area that is greater than the reflective surface area of the at least one reflector.

16 Claims, 13 Drawing Sheets

LIGHT SOURCE FOR UNIFORM ILLUMINATION OF A SURFACE

CLAIM OF PRIORITY UNDER 35 U.S.C. § 120

The present Application for patent is a Continuation of patent application Ser. No. 14/874,128 entitled "LIGHT SOURCE FOR ILLUMINATION OF A SURFACE" filed Oct. 2, 2015, which claims priority to Provisional Application No. 62/058,866 entitled "Light Source for Uniform Illumination of a Surface" filed Oct. 2, 2014, and assigned to the Assignee hereof, the entire contents of which are hereby expressly incorporated by reference herein.

BACKGROUND

Field

The present invention relates generally to illumination devices including reflective optics for illuminating a surface.

Background

For many applications, it is desirable to produce uniform illumination across a space. Conventionally, this is accomplished using light fixtures such as troffers; the interior surface of a troffer captures light emitted from a light source and redistributes it to generate reasonably homogeneous illumination in a workspace, such as a commercial office space, a residential room, or a lab facility. Most light in this design, however, is directed vertically downward, creating undesirable overhead glare. As human eyes shift their gaze from, for example, computer monitors to brighter and darker areas, the eye muscles must adjust in response; over time, this may result in eyestrain and headaches. In addition, because ceilings, walls, and even horizontal spaces between the fixtures can be underlit, troffers typically produce unsatisfactory illumination uniformity. Accordingly, there is a need for illumination devices that effectively and efficiently illuminate a desired region uniformly with little or no glare.

SUMMARY

An example disclosed herein addresses the above stated needs by providing a device for uniform illumination of a target surface. The exemplary device has an elongated light source extending along an x axis and at least one reflector having a length relative to the x axis and a reflective surface area. The reflective surface area has a profile having a plurality of curved reflective segments. The target surface has a target surface area that is greater than the reflective surface area. The target surface has a proximal region and a distal region, the proximal region having an intersection between the target surface and a normal of the light source, the distal region being further from the intersection than the proximal region is. A first curved reflective segment is configured to reflect light to the distal region of the target surface. A second curved reflective segment is configured to reflect light to the proximal region of the target surface. The elongated light source and the at least one reflector are arranged such that the at least one reflector is configured to directly intercept and reflect a portion of light emitted by the light source to thereby cause substantially uniform illumination of the target surface. The light reflected by the first curved reflective segment, and the light reflected by the second curved reflective segment cross paths.

Another example disclosed herein includes an exemplary method for uniform illumination of a target surface. The exemplary method includes emitting light by an elongated light source, the elongated light source extending along an x axis; and causing at least one reflector extending parallel to at least a portion of the elongated light source and having a plurality of curved reflective segments to directly intercept and reflect a portion of light emitted by the elongated light source. The at least one reflector has a reflective surface area. The method includes causing a first curved reflective segment to reflect light to the distal region of the target surface. The method includes causing a second curved reflective segment to reflect light to the proximal region of the target surface. The method includes causing the light reflected by the first curved reflective segment and the light reflected by the second curved reflective segment to cross paths. The method includes effecting substantially uniform illumination of the target surface, the target surface having an area greater than the reflective surface area of the at least one reflector.

Another example disclosed herein provides a device assembly having a light source configured to be coupled to a mounting surface, and at least one reflector. The reflector is configured to be coupled to at least one of the light source or the mounting surface, and interposed between the light source and the mounting surface, the reflector having a reflective surface area and a plurality of curved reflective segments. The reflector is shaped and arranged relative to the light source such that the reflector directly intercepts and reflects a portion of light emitted by the light source to the target surface to thereby cause substantially uniform illumination of the target surface. The target surface has a surface area that is greater than the reflective surface area of the at least one reflector.

DETAILED DESCRIPTION

Figure 1:
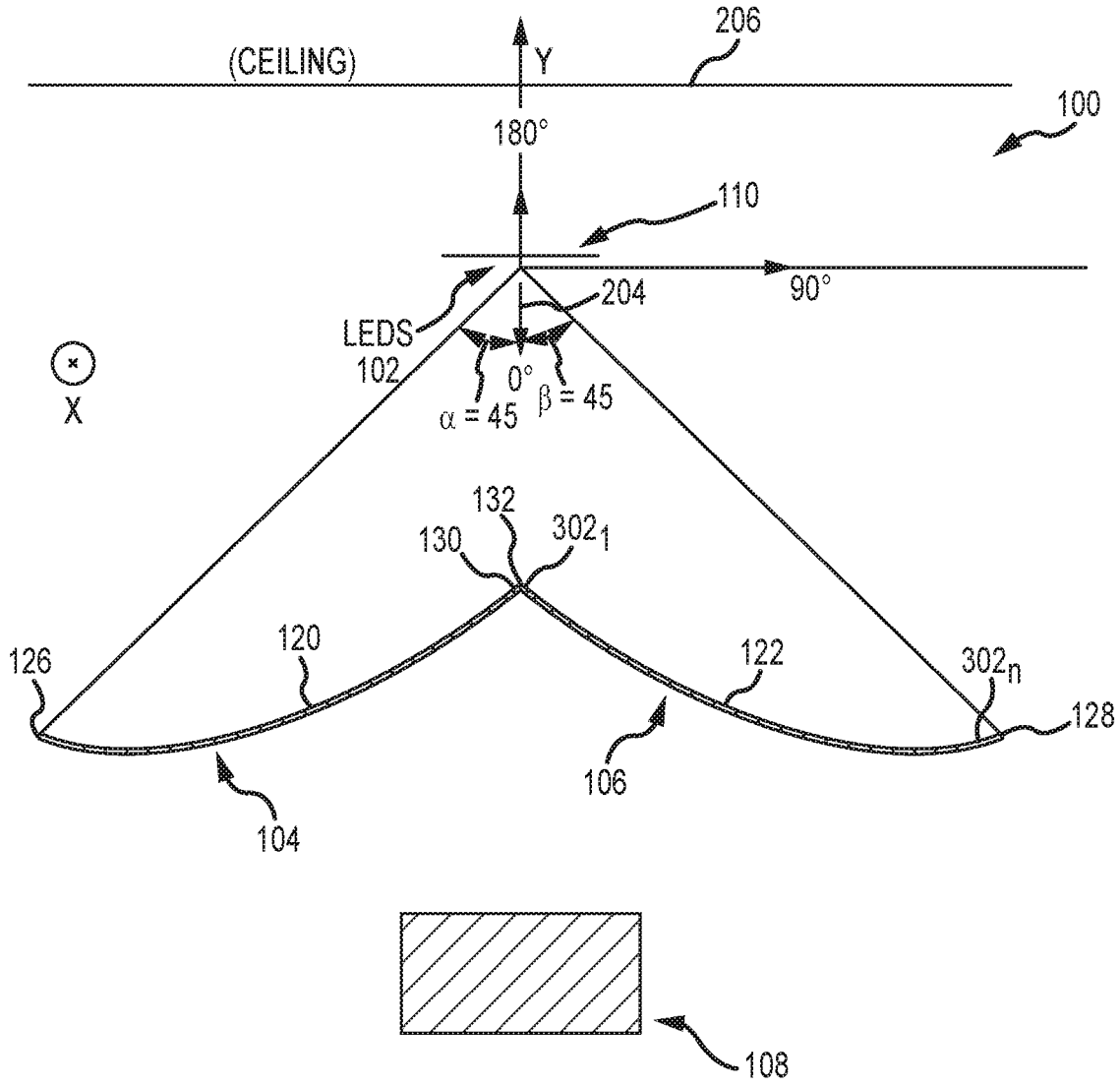
FIG. 1 is a side section view illustrating reflectors.
Figure 1A:
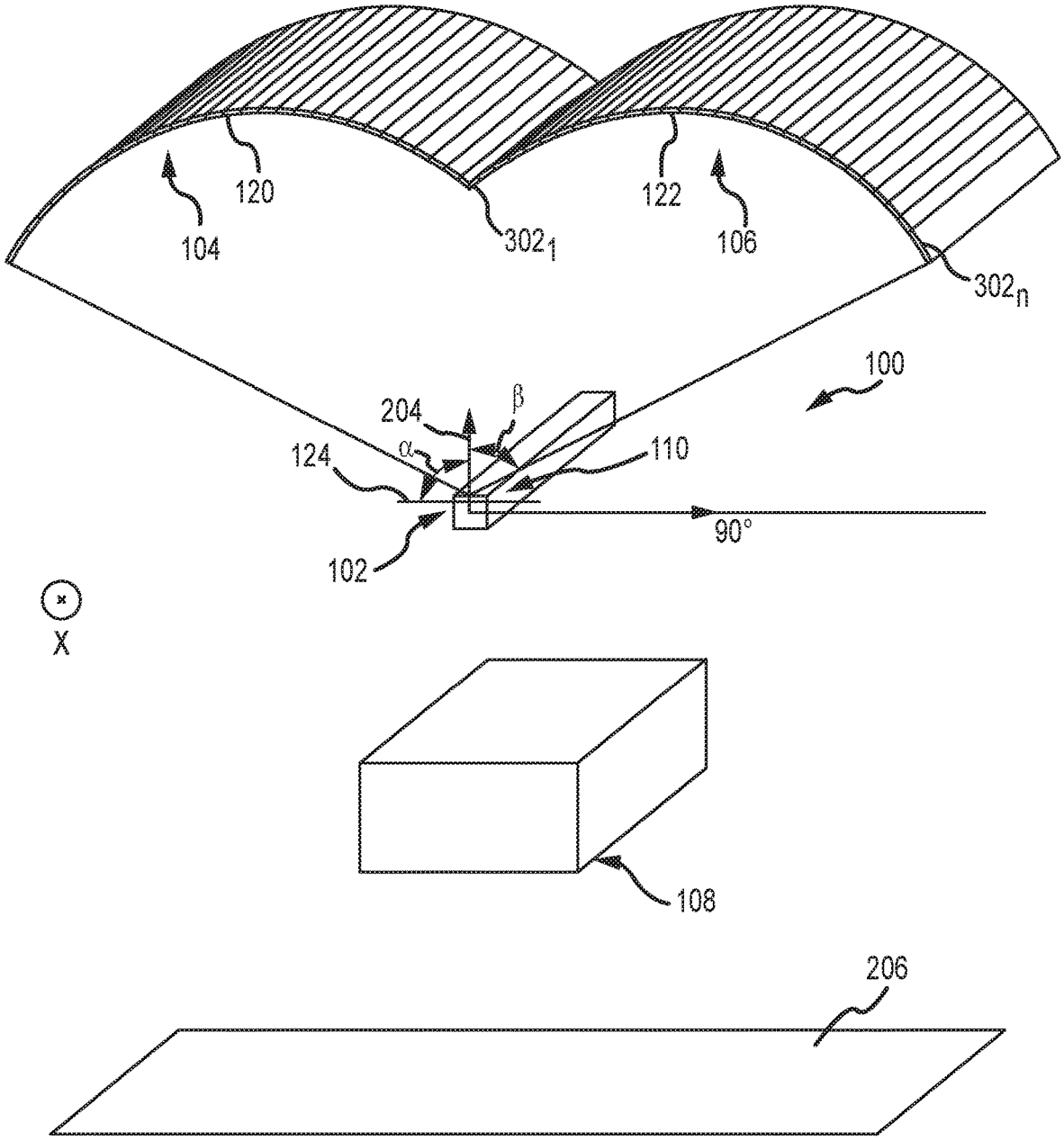
FIG. 1A illustrates an exemplary arrangement of reflectors relative to a light source and target surface.

Referring to FIG. 1, in various embodiments, an exemplary light device 100 includes a light source 102 and at least one reflector 104. In some embodiments, a plurality of reflectors 104, 106 are provided. In some embodiments, a plurality of reflectors 104, 106 are provided facing the light source 102 and placed between the light source 102 and the workspace 108 or illumination surface. In some embodiments, and as illustrated in FIG. 1A, the light source 102 is provided between the reflectors 104, 106 and the workspace 108 or illumination surface. For the purpose of this disclosure, the terms "workspace" and "illumination surface" may be used interchangeably. Further, although the figures generally depict a workspace or illumination surface that is below the light source 102, the workspace 108 or illumination surface may be above or adjacent to the light source 102, and, again, the light source 102 may be between the reflectors 104, 106 and the workspace 108 or illumination surface, or the reflectors 104, 106 may be between the illumination surface or workspace 108 and the light source 102. In the latter case, in some embodiments, the reflectors 104, 106 may be configured or positioned to reflect light to a ceiling, wall, troffer, or other illumination surface 206 that then redirects the light to the workspace 108, as illustrated in FIG. 1.

In some embodiments, a plurality of reflectors 104, 106 are provided as mirror images of one another. A reflective surface area 120, 122 (see e.g. FIG. 1A) of the reflectors 104, 106 is typically larger than the emission surface area 124 of the light source 102 (e.g., by a factor of 10 or greater) such that light exiting from light source 102 may not be directly emitted into the workspace 108. The light source 102 may include a linear array of small light-emitting diodes (LEDs) disposed (e.g., as dies) on a substrate 110 for providing a high light output (e.g., 40 lm/cm), or any other light source 102 tending to emanate light that is not diffused but rather tending to concentrate in a single direction, thus forming a "hot spot", although the reflectors 104, 106 may be used with any light source. The LEDs may be spaced sufficiently close together (e.g., 1 cm apart) to form a substantially continuous "line source" such that the light emitted therefrom is uniform along the length thereof. Alternatively, the light source 102 may include a single large LED die or multiple parallel linear LED arrays disposed on the substrate 110.

In various embodiments, the light source 102 may be an LED array, and may or may not include built-in optics (e.g., a collimating lens) that may collimate the light and direct it independent of the reflectors 104, 106. The reflectors 104, 106 may be elongated reflectors (e.g., extrusions) positioned or configured to be positions to run parallel to the arrangement of the light source 102 or LEDs (i.e., in the x direction) for redirecting light emitted from the light source 102.

Figure 8:
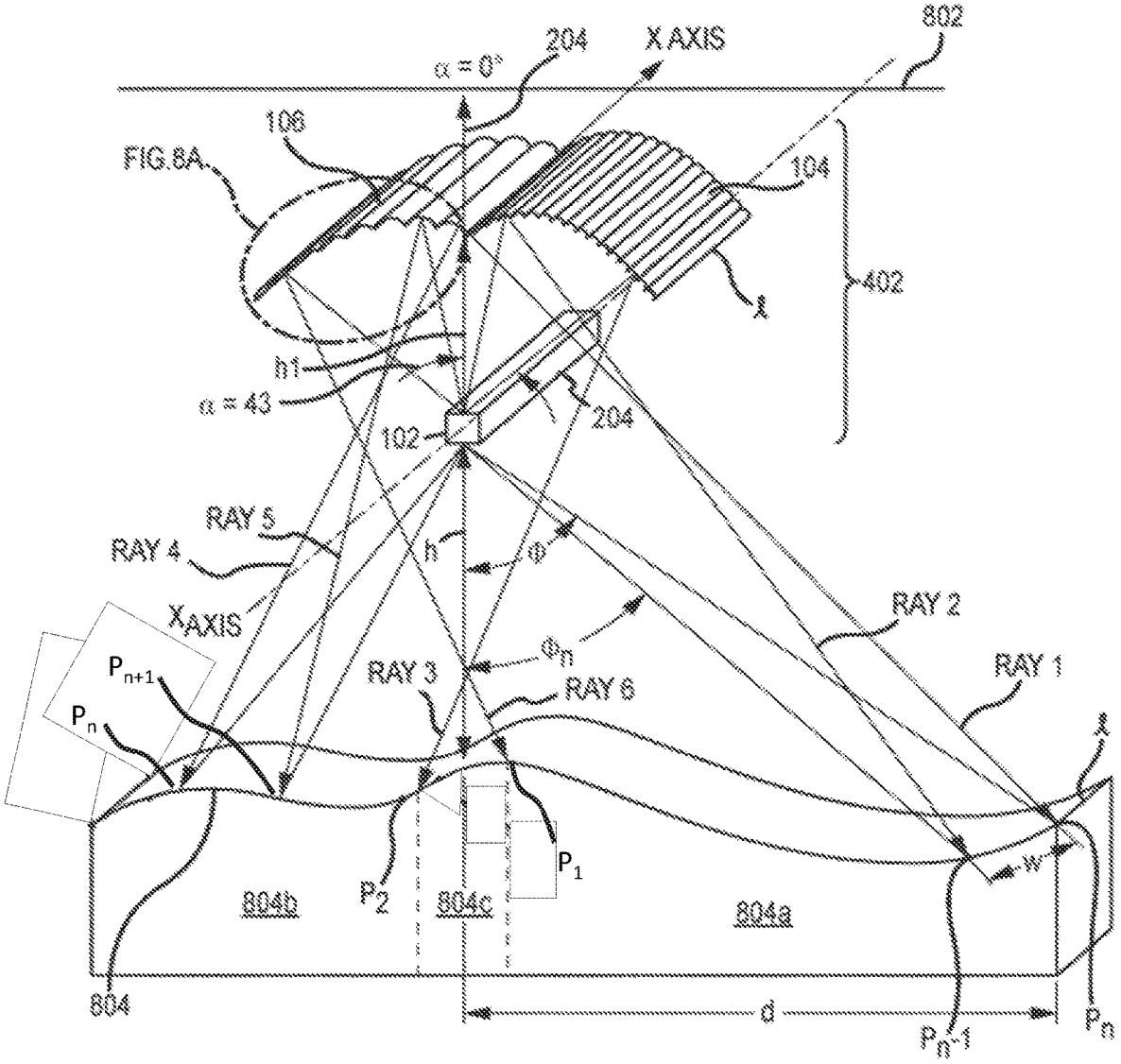
FIG. 8 is a side perspective view of a linear light assembly uniformly illuminating an irregular target surface.

In some embodiments, the reflectors 104, 106 and the light source 102 are arranged linearly or are elongated in a linear direction; see, for example, FIG. 8, illustrating a linear x axis. That is, the x direction or an x axis along which the reflectors 104, 106 and/or light source 102 are positioned may be linear in some embodiments. In some embodiments, the x direction or x axis may be curved within a plane A comprising a centerline of the light source 102 or a line or plane of maximum lighting intensity of the light source 102. In some embodiments, the x direction or x axis may be curved three-dimensionally (not illustrated), include an angle, or otherwise have a non-linear shape.

Figure 2A:
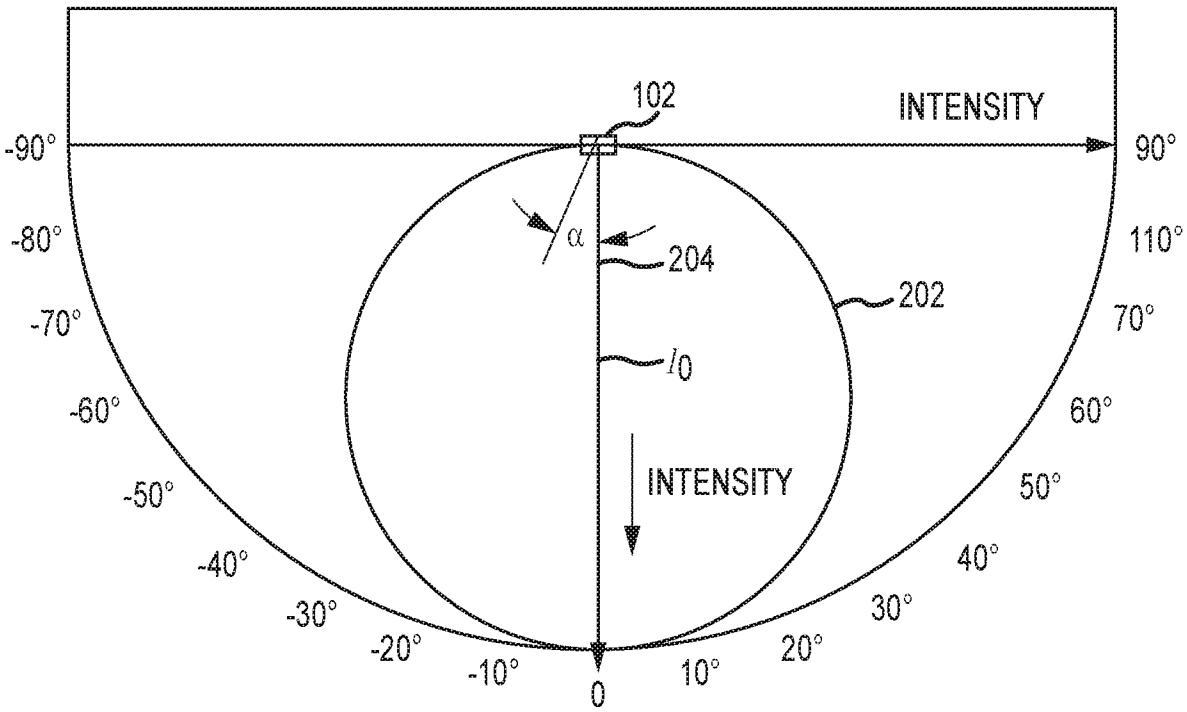
FIG. 2A is a 2-dimensional illustration of how light output of an exemplary light source may emanate over a $2\pi$ steradian solid angle.

FIG. 2A is a 2-dimensional illustration of how the light output of the light source 102 may emanate over a $2\pi$ steradian solid angle 202 (i.e., approximately a half sphere) symmetric with respect to the surface normal 204 thereof. That is, the light intensity decreases as the angle $\alpha$ increases; relatedly, the reflectors 104, 106 (see FIG. 1) may be positioned relative to the region having the greatest intensity.

As illustrated in FIG. 1, either or each of the reflectors 104, 106 may subtend an angle $\alpha$ of approximately 45° (or greater but preferably less than 90°), measured from the center of the LED array or light source 102, for providing the maximum lateral coverage and efficiently utilizing light emitted from the light source 102. That is, a line drawn from a normal 204 of the light source 102 to a distal end 126, 128 of one of the reflectors 104, 106 may form an angle of about 45°, although a smaller or larger angle $\alpha$ is contemplated. Thus, the reflectors 104, 106 may intercept at least 80% of the light emitted from the LED array or light source 102 and project the intercepted light onto an illumination surface or illumination surface 206. Utilizing the reflectors 104, 106, therefore, provides efficient energy transfer and redistribution on an illumination surface 206 and avoids light waste and escape that may cause glare. An illumination surface 206 may be roughly defined by a region of a workspace 108 or an illumination surface such as a ceiling, wall, or illuminated object.

Continuing with FIG. 1, those skilled in the art will understand that, the reflectors 104, 106 should not subtend an angle of 90° (or greater). Because the distal portions 126, 128 of the reflectors 104, 106 in this case would block light reflected by the inner or proximal portions 130, 132 thereof, shadows may be created on the illumination surface 206. In addition, the light source 102, substrate 110, and other structures supporting the light source 102, such as LEDs, may also result in shadows on the illumination surface 206.

In some embodiments, the reflectors 104, 106 may be configured to define a relatively narrow region of illumination surface 206 on one or both sides of the light source 102. Such an embodiment may be desirable where spotlight-type fixtures are used (e.g., illuminating art, landscape lighting) or where glare is to be avoided (e.g., reading lights) to name two non-limiting examples.

Figure 2B:
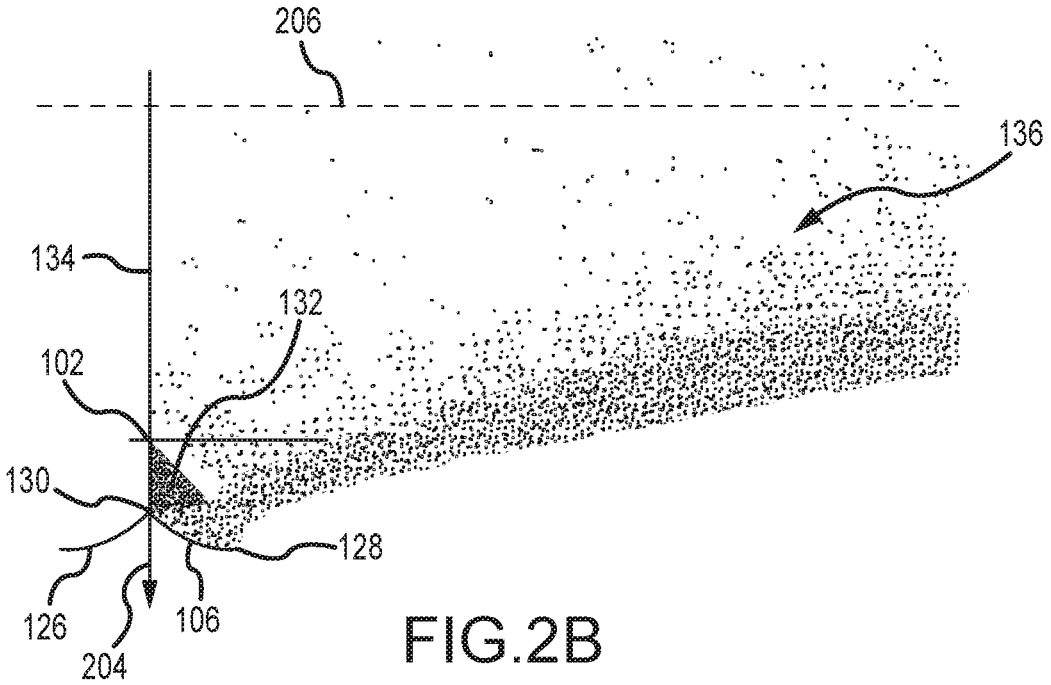
FIG. 2B depicts how exemplary reflectors may direct light reflected from one reflector to the region directly behind a light source.

Referring now to FIG. 2B, in some embodiments, the reflectors 104, 106 are configured to direct light reflected from one reflector towards a region 134, 136 behind the light source 102, and if necessary, above the other reflector 104, 106. Reflecting light to a region 134, 136 behind the light source 102 advantageously provides illumination in regions that are behind the light source 102, substrate 110 (see e.g. FIGS. 1 and 1A), and other supporting structures, thereby avoiding shadow formation. To achieve this, in some embodiments, the reflectors 104, 106 are configured such that light emitted towards the subtended edges or distal edges 126, 128 that are furthest from the surface normal 204 of the light source 102 or LEDs is directed to the region 134, directly behind the LEDs or light source 102, whereas light emitted towards the central region near the surface normal 204 of the LEDs, that is, near the proximal regions 130, 132 of the reflectors 104, 106 is diverted to the furthest region 136 of the illumination surface 206, the furthest region 136 of the illumination surface 206 being that region 136 which is most distal from an axis defined by the surface normal 204 of the light source 102. In some embodiments, light emitted from the light source 102 at an angle α, β (see FIG. 1) approaching 45° from the normal 204 of the light source 102 is reflected towards an illumination surface 206 or ceiling and a line comprising the normal 204 at a point near the light source 102. In some embodiments, light emitted from the light source at an angle α, β (see FIG. 1) approaching 0° from the normal 204 is reflected towards an illumination surface 206 or ceiling such that the reflected light is not reflected towards the line comprising the normal 204

Figure 2C:
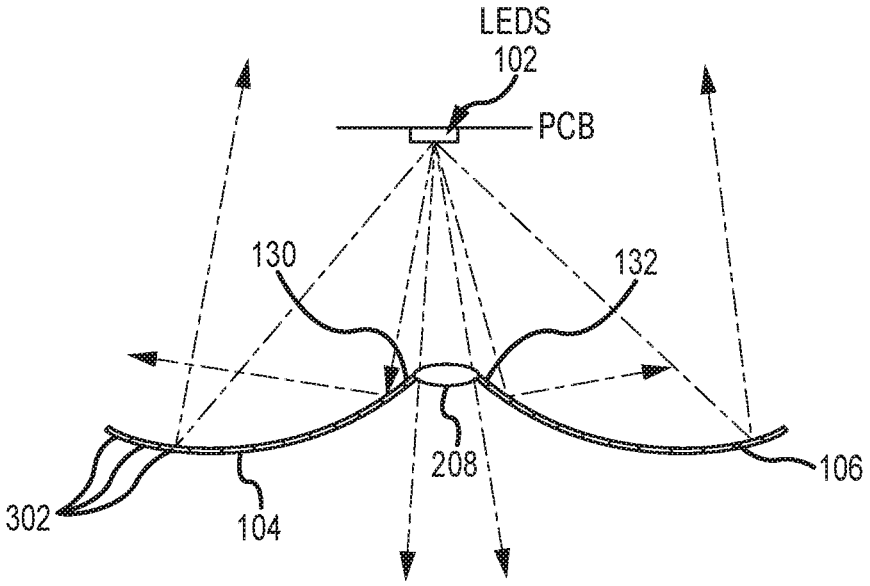
FIG. 2C is a side perspective view of two exemplary reflectors with an optical element therebetween.

As shown in FIG. 2C, the reflectors 104, 106 may be placed apart with an optical element 208 therebetween. That is, while the proximal ends 130, 132 may, in some embodiments be coupled together, abutting, or unitary with one another (see e.g. FIG. 1), in some embodiments, the proximal ends 130, 132 may be spaced apart as illustrated in FIG. 2C. The optical element 208 may aid in producing uniformity of illumination in the workspace 108 or illumination surface 206 and/or provide decorative illumination utilizing light emitted from the light source 102. In some embodiments, the optical element 208 may be elongated and parallel to the x axis previously described herein. In some embodiments, the optical element 208 may be a diffusing transparent/translucent material (e.g., a textured plastic), or a refractive optic that yields a divergent beam (e.g., a plano-concave or a double concave lens). In some embodiments, the transparent material is colored to add a decorative element. In addition, separation of the reflectors 104, 106 may allow the positions of the reflectors to be independently adjusted (e.g., by rotation or translation) by, for example, a conventional actuator, for producing maximum illumination uniformity. Although, in other embodiments, the optical element 208 and/or a spacing between the reflectors 104, 106 is not required in order to independently adjust the reflectors 104, 106.

In particular, the reflectors 104, 106 may, in some embodiments, be adjusted manually and/or by an actuator (not illustrated) using any means known to those skilled in the art. For example, an actuator responsive to an input such as, without limitation, a timing, motion, or other sensing device may be configured to adjust the reflectors 104, 106 so as to adjust a desired illumination surface 206. As but one example, a user may wish to have reflectors 104, 106 that adjust light to illuminate a relatively large workspace 108 during the day, but to merely illuminate a small region of the workspace 108 during the night. Alternatively, motion or lack thereof for a period of time can trigger the adjustment. As another example, the reflectors 104, 106 may be adjustable so as to provide an artistic or interactive illumination of an illumination surface 206. Those skilled in the art will envision any number of means for actuating the reflectors 104, 106 and/or attaching actuation means to the reflectors 104, 106 in a manner that minimizes shadowing—with just one example being utilizing the optical element 208 as an actuator mounting means and shadow minimizing means.

Figure 3A:
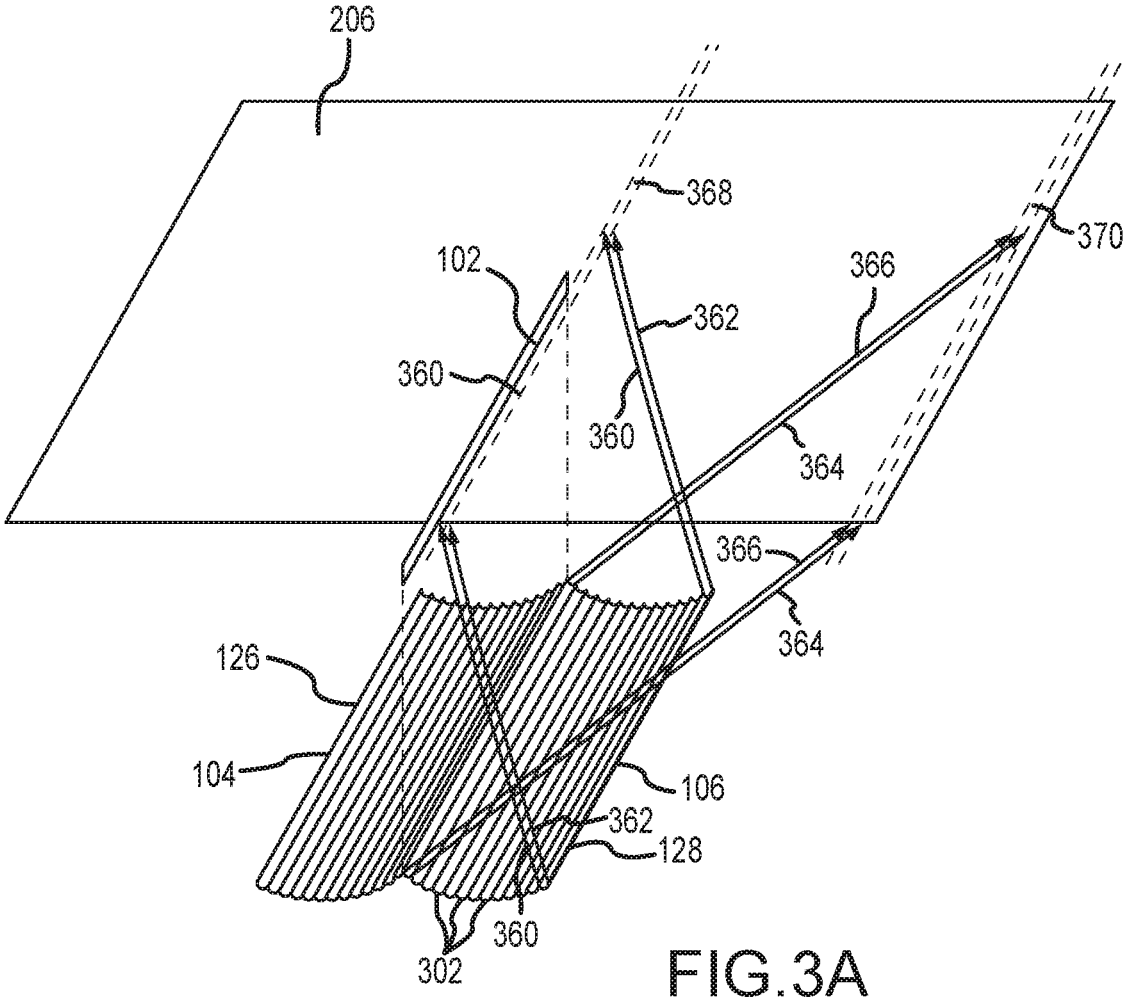
FIG. 3A is a perspective view of exemplary reflectors having multiple segments.
Figure 3B:
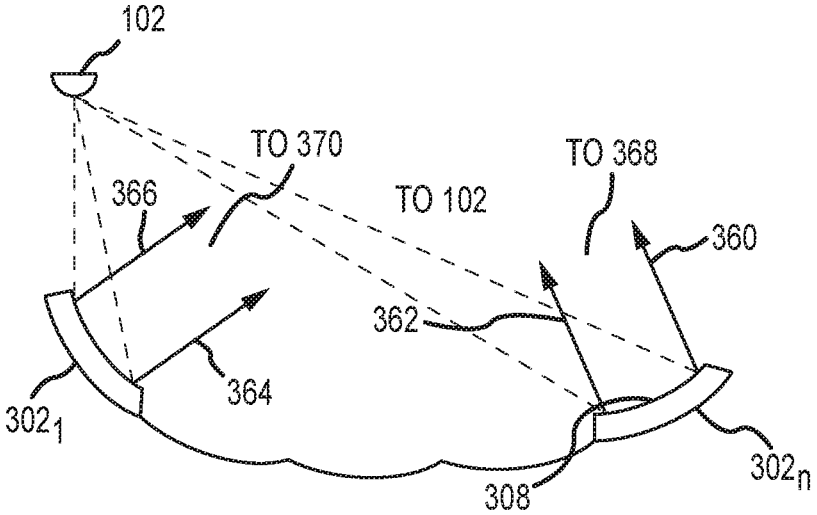
FIG. 3B is a side view of one of the segments illustrated in FIG. 3A.

Referring now to FIGS. 3A-3B (and in view of FIG. 1), each of the reflectors 104, 106 may include multiple segments 302; each segment 302 may have a substantially elliptical surface profile and subtend the same or different angles relative to another segment 302. As illustrated in FIG. 3B, in some embodiments, reflected focal lines 360, 362 of a distal segment $\mathbf{302}_n$ extend substantially parallel to each other to illuminate a proximal region 368 of the illumination surface 206, that is, a region 368 proximal to the light source 102. Reflected focal lines 364, 366 of a proximal segment $\mathbf{302}_1$ may extend substantially parallel to each other to illuminate a distal region 370 of the illumination surface 206. The segments 3021, 302*n* may be configured to cause the same lighting intensity on proximal region 368 and the distal region 370, despite the proximal and distal segments $\mathbf{302}_1$, $\mathbf{302}_n$ experiencing dissimilar lighting intensity from the light source 102. By placing the light source 102 coincident or near one of the geometric conjugate focal lines 360, 362 of the elliptical segments $\mathbf{302}_n$, a portion of light emitted from the light source 102 is directly intercepted (i.e., without any intervening reflection and/or scattering by other objects) and reflected by the segments 302. The light directly intercepted and reflected by the segments 302 then passes through the other focal lines 364, 366 of the elliptical segments 302 distributed over the illumination surface 206. Accordingly, these embodiments may provide improved uniform illumination on the illumination surface 206.

Figure 3C:
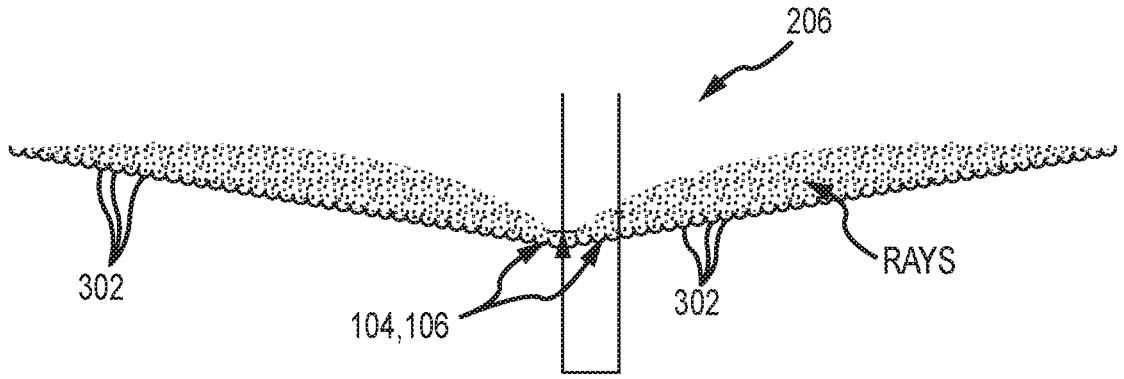
FIG. 3C illustrates a distribution light reflected by the device in FIG. 3A.
Figure 3D:
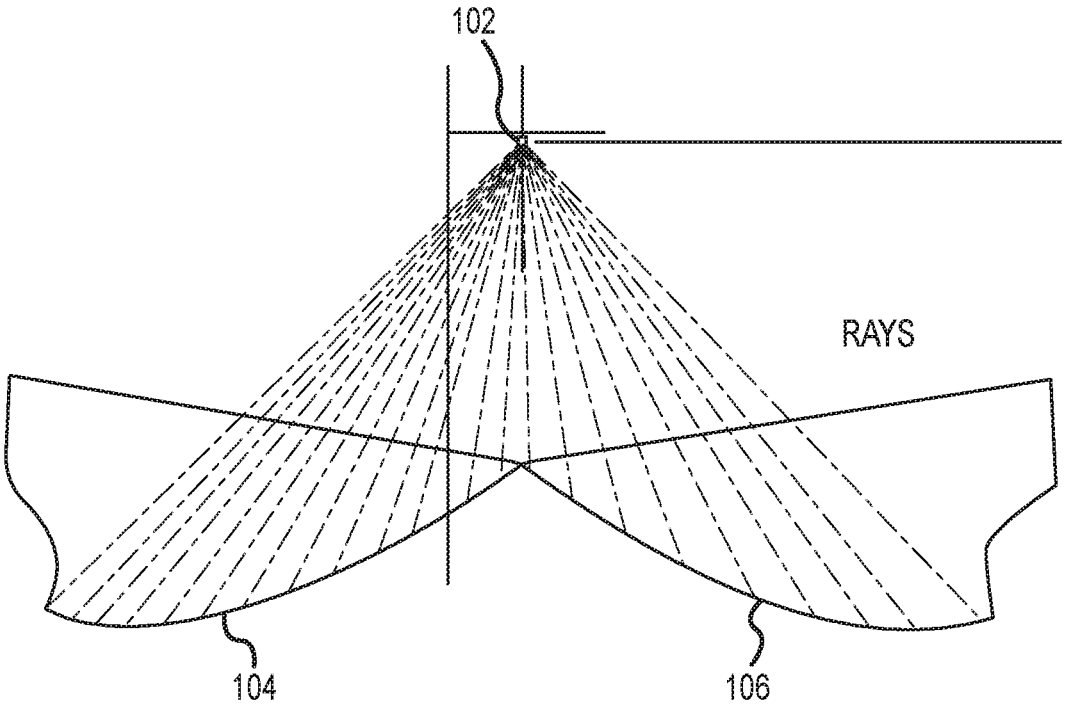
FIG. 3D illustrates projections of light rays reflected by the device in FIG. 3A.

FIGS. 3C and 3D depict ray traces of light emitted from the light source 102 and subsequently redistributed on the illumination surface 206 via the reflectors 104, 106.

Referring again to FIG. 2A, the luminous intensity I of light emitted from the light source 102 and received at an angle α between the observer's line of sight and the surface normal 204 of the light source 102 is proportional to the cosine of the angle α. In some embodiments, a Lambertian distribution or cosine distribution may adequately define the intensity I at various angles α from the normal 204.

$$I=I_0 \cos n\alpha \qquad \text{eq. (1)}$$

where $I_0$ is the luminous intensity at the surface normal 204 of the light source 102 (i.e., α=0). To simplify the calculation, n is assumed to be one. Thus, based on light emitted from the light source 102 available to the reflectors 104, 106, each elliptical segment 302 thereof may be sized, curved, and/or oriented to uniformly illuminate the illumination surface 206, workspace, or surface. For example, because the illuminated area on the illumination surface 206 increases with the angle of incidence with respect to the illumination plane, regions that are further away from the light source 102 may require more light to create a uniformly illuminated surface; whereas regions nearly directly above the light source 102 require less light to create uniform illumination. Thus, the segments 302 of elliptical reflectors 104, 106 may be configured to redirect light emitted by the light source 102 from the regions of greater illumination intensity to the regions further from the light source 102.

Figure 4:
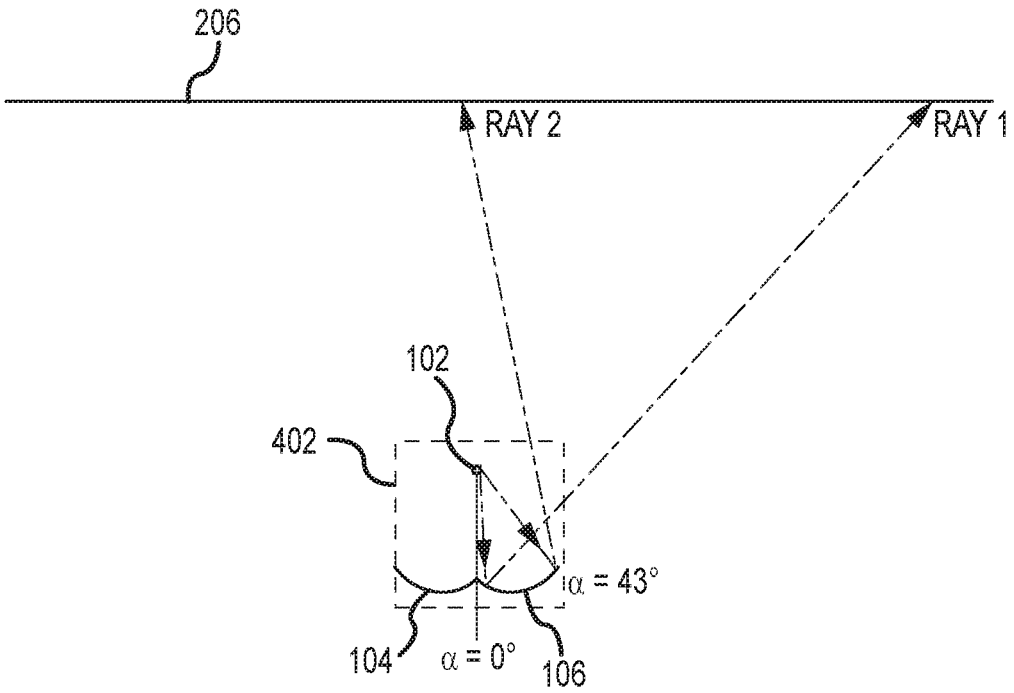
FIG. 4 is a side view of a light assembly reflecting light to a target surface.

Referring to FIG. 4, the reflector segment 302 (not shown in FIG. 4 for clarity) that receives light having the greatest intensity (i.e., at α=0°) may be configured to redirect light to illuminate the region that is furthest from the LED array or light source 102 (Ray 1); whereas the reflector segment that receives light having the lowest intensity (i.e., at α=45°) may be configured to redirect light to illuminate the region that is closest to the LED array or light source 102 (Ray 2). The reflective area 308 (see FIG. 3B) of each segment 302 may be determined in accordance with the corresponding illumination area 210 (see FIG. 5), the received light intensity emitted from the LEDs or light source 102, reflectivity as a function of the angle of incidence, polarization effects, etc.

Figure 8A:
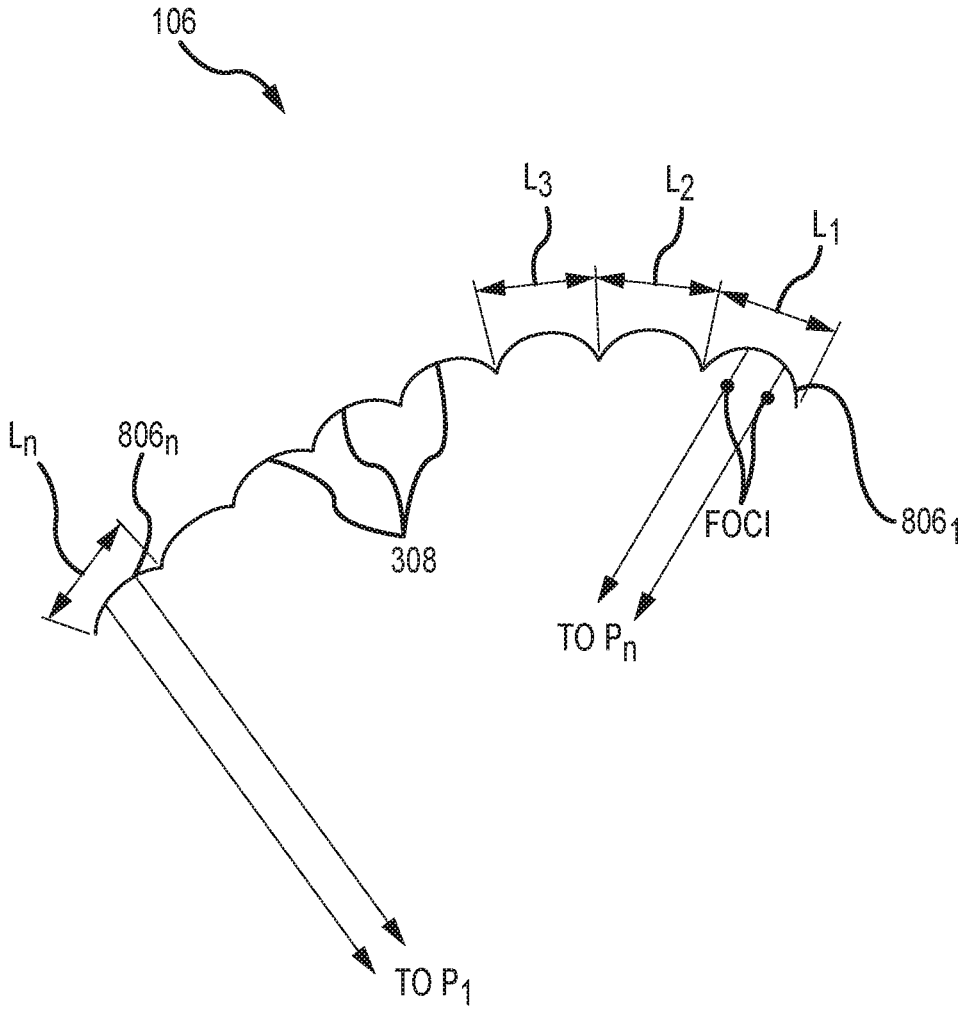
FIG. 8A is a side view of a reflector in the assembly of FIG. 8.

Turning now to FIGS. 8-8A, in some embodiments, the reflective area 308 of each of the segments $\mathbf{806}_1 \ldots \mathbf{806}_n$ is substantially the same. That is, a length L1 . . . Ln of each segment $\mathbf{806}_1 \ldots \mathbf{806}_n$ in a reflector 104, 106 may be identical to the length $L_1 \ldots L_n$ of the other segments $\mathbf{806}_1 \ldots \mathbf{806}_n$ in the same reflector 104, 106.

In some embodiments, and as illustrated in FIG. 8A, segments $\mathbf{806}_1$ (see also Ray 1 in FIG. 8) that direct light to the regions that are farthest away from the light source 102 may have the largest surface area 308 for reflecting the largest portion of light. In contrast, segments $\mathbf{806}_n$ that direct light to the regions closest to the light source 102 may have the smallest reflective area 308. That is, some segments $\mathbf{806}_1 \ldots \mathbf{806}_n$ may have a length $L_1$ that is greater than a length $L_n$ of other segments $\mathbf{806}_1 \ldots \mathbf{806}_n$. In some embodiments, the segments $\mathbf{806}_1$ most proximal to the normal 204 of the light source 102 may be longer and have a greater surface area 308 than those segments $\mathbf{806}_n$ that are most distal of the normal 204 of the light source; however, as will be described subsequently in this disclosure, other design factors may result in a different relative area of each segment $\mathbf{806}_1 \ldots \mathbf{806}_n$ (such as where an oddly shaped surface is desired to be illuminated). In some embodiments, the dimensions of the illumination surface 206 are much larger than those of the light source(s) 102 (e.g., by a factor of twenty or greater) such that the average illumination area 210 (defined by l and d in FIG. 5) on the illumination surface 206 is reduced; this results in little or no glare in the workspace.

In some embodiments, the distance $h_1$ (see e.g. FIG. 8) between the light source 102 and the reflectors 104,106 is much smaller (e.g., on the order of 2 cm) than the distance h (see e.g. FIG. 8) between the reflectors 104, 106 and the illumination surface 206 (e.g., on the order of 30 cm); as a result, the light source 102 and reflectors 104, 106 may be considered as a single "LED-reflector assembly" 402 as depicted in FIG. 4. That is, the distance $h_1$ may be assumed to be zero in the equations that appear in this disclosure.

Figure 5:
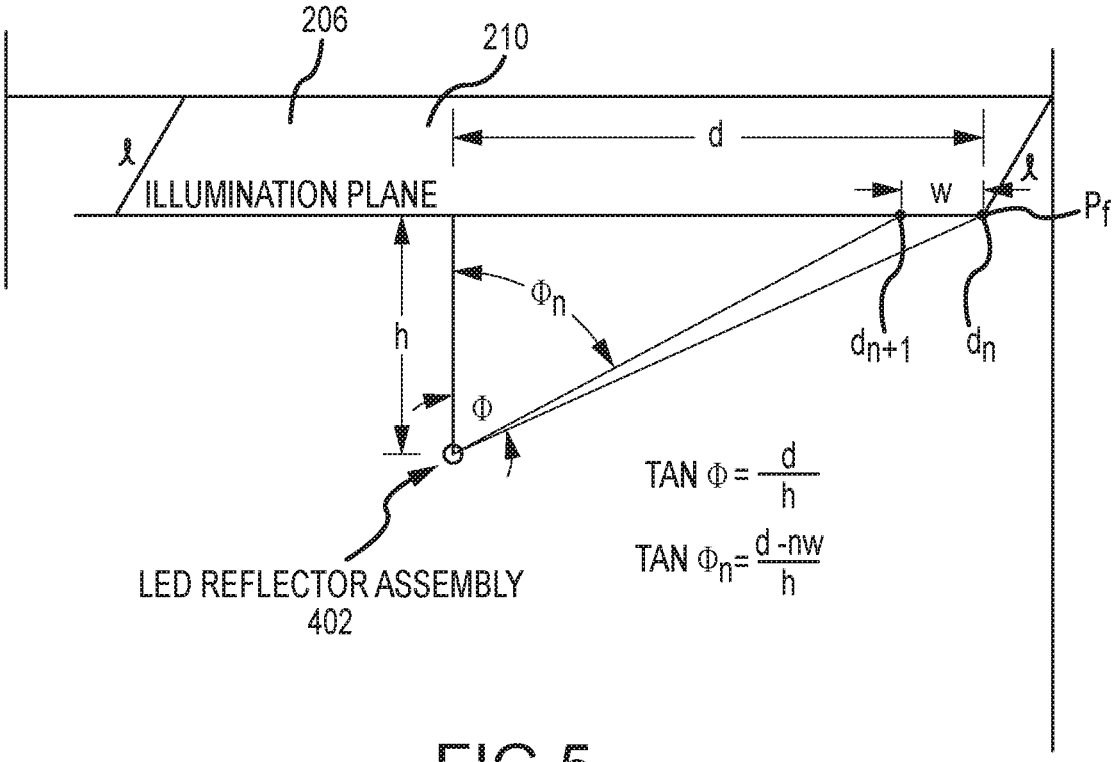
FIG. 5 is a side view illustrating more characteristics of the light assembly in FIG. 4.

Referring to FIG. 5, the width d of a first half of the entire illumination surface 206 or illumination region 210, the distance h between the LED-reflector assembly 402 and the illumination surface 206, and the design angle Φ between the furthest point to $P_f$ be illuminated on the surface 206 and the surface normal 204 of the LED array 102 satisfy the equation:

$$\tan \Phi = d/h$$

In an exemplary configuration where d=2 meters and h=0.305 meters, Φ is approximately 81.3°, these values indicate that light emitted from the light source 102 can be reflected and distributed over the illumination area 210 that extends from 0° to 81.3° (i.e., 0°<Φ<81.3°).

Referring again to FIG. 5, the illuminated area 210 between the second focus $d_{n+l}$ of the (n+l)th reflector segment 302 and the second focus $d_n$ of the nth reflector segment 302, on the illumination surface 206 may be given as:

$$l(d_{n+l}-d_n)=lh(\tan \Phi_{n+l}-\tan \Phi_n) \quad \text{eq. (2)}$$

where $\Phi_n$ is a design angle between the second focus of the nth reflector segment and the surface normal 204 of the LED array or light source 102, and l is the length of the stripe of the illuminated area 210.

In various embodiments, the second geometric foci 306 (see FIG. 3B and FIG. 8) of the elliptical segments 302 are evenly spaced over the illumination surface 206; that is, $w=d_2-d_1=d_3-d_2=d_4-d_3$ (see FIG. 5), resulting in a constant sub-illumination area of each segment 302. Therefore, to the first order, the variation of illumination intensity on the illuminated surface 206 simply results from the Lambertian distribution of the LED or light intensity. Accordingly, illumination uniformity on the illuminated surface 206 may be achieved by adjusting the area 308 of each segment 302 (or a weighting factor of each segment area 308) in accordance with the inverse of the cosine α function.

For example, where the reflectors 104, 106 subtend an angle of 45° on each side the light source 102, monotonically varying the weighting factors of the segment area 308 between 0.5 and 1 over the design angle Φ produces sufficient uniform illumination on the surface 206.

Figure 6:
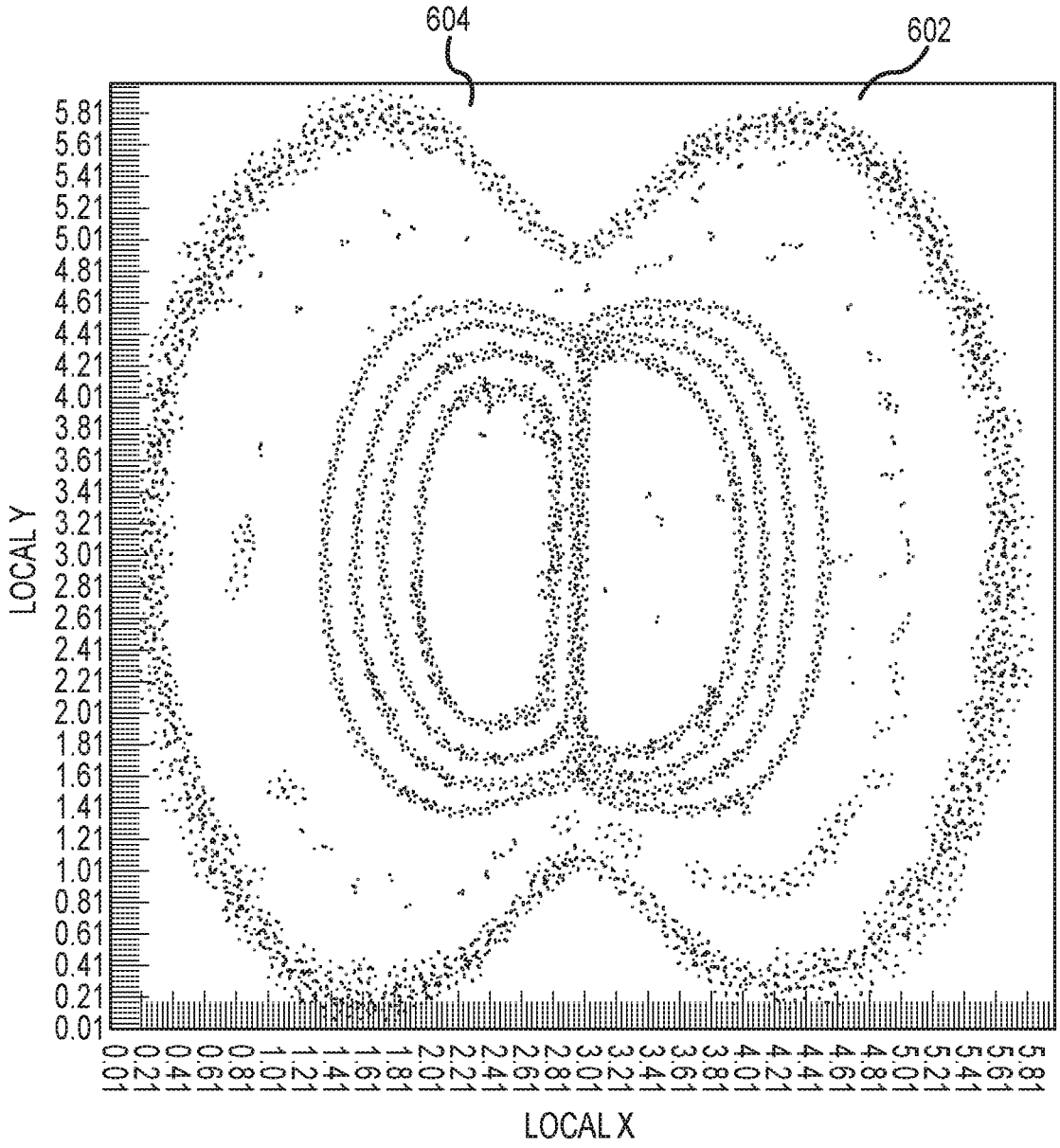
FIG. 6 is a graphical depiction of light intensity resulting from two types of reflectors.

FIG. 6 depicts increased illumination uniformity and intensity 602 using the segments whose reflective area is weighted as described above; by contrast, the output 604 has lower intensity and less uniformity when the reflective area of the segments is not weighted (i.e., each having the same reflective area). In some embodiments, the segment areas may be further tuned based on the distances between each segment 302 and LED array or light source 102 for obtaining a higher level of illumination uniformity.

Although the segments 302 of the reflectors 104, 106 may have an elliptical surface profile, they may have any curved surface shape that is configured to control where light is reflected. For example, the segments 302 may have a parabolic profile. By placing the light source 102 at the focus of the parabolic segments, each parabolic segment may distribute light at an angle directed toward the illumination surface 206. In some embodiments, the directing angles of the parabolic segments are evenly distributed over the illumination plane (i.e., $\Phi_2-\Phi_1=\Phi_3-\Phi_2=\Phi_4-\Phi_3$). Because even angular distribution results in a larger illumination area 210 on the illumination surface 206 as the directing angle Φ increases, the area of the segment (or the weighting factor thereof) is also selected to increase with the directing angle Φ for collecting and redirecting more amount of light emitted from the light source 102, thereby obtaining uniform illumination. Additionally, as described above, variations of the light intensity at each angle α may be considered. As a result, the falloff of the light intensity from the light source 102, 402 may be expressed as a function of the angles α and Φ:

$$I(\alpha) = I_0 \cos\alpha\left(\frac{\Phi_{max}}{\alpha_{max}}\right) \quad \text{eq. (3)}$$

Using eq. (3), the range of incidence angles of the reflector segments 302, $\mathbf{806}_1 \ldots \mathbf{806}_n$ may then be scaled in accordance with the range of α (i.e., the angle that light exits the light source 102, 402). Additionally, because the illuminated area (w by l in FIG. 5) of each segment 302 increases with Φ (as given in eq. (2)), the weighting factor of each segment area can then be calculated as the inverse of the expected falloff intensity. In embodiments where the directing angles Φ of the parabolic segments are evenly distributed over the illumination plane, the weighting function is computed as:

$$\left[\frac{\cos\alpha\left(\frac{\Phi_{max}}{\alpha_{max}}\right)}{h(\tan\Phi_{n+1}-\tan\Phi_n)}\right]^{-1} \quad \text{eq. (4)}$$

Figure 7:
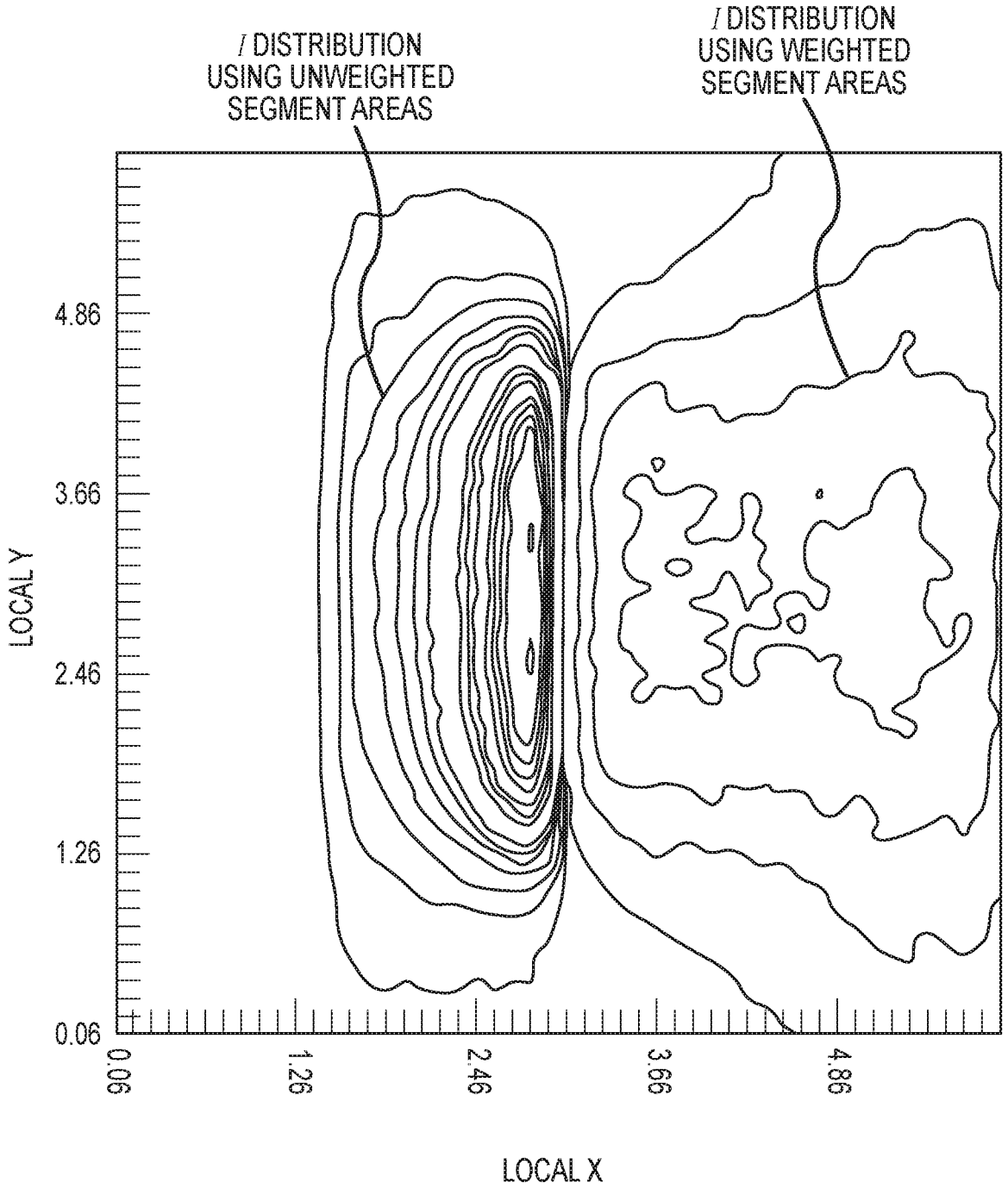
FIG. 7 is another graphical depiction of light intensity resulting from two types of reflectors.

FIG. 7 illustrates the improvement in illumination uniformity resulting from weighting the segment areas 308 utilizing the weighting function of eq. (4). Using the unweighted areas 308 of the reflective segments 302 (i.e., each segment has the substantially same area), illumination intensity varies rapidly with the distance away from the centrally located light source 102 (as shown by the closely spaced contour lines on the left side of FIG. 7). By contrast, illumination uniformity is achieved using the weighted segment areas based on eq. (4) (as shown by the sparsely spaced contour lines on the light-hand side of FIG. 7).

Turning now to FIG. 8, some embodiments provide a light assembly 402 comprising an elongated light source 102 and at least one reflector 104, 106, wherein the light source 102 is a distance $h_1$ from the reflector 104, 106 and wherein the light source 102 is configured to be coupled to the reflector 104, 106 and/or a mounting surface 802. The reflector 104, 106 may likewise be coupled to or configured to be coupled to a mounting surface 802 and/or the elongated light source 102. The light source 102 may be elongated relative to or comprise an x axis and a length l measured along the x axis.

In some embodiments, the light assembly 402 is configured to evenly illuminate an illumination surface 804 that has an irregular profile (e.g., non-planar), a vertical distance h from the elongated light source 102. The distance $h_1$ may be much shorter than the distance h, and may be assumed to be zero in the equations in this disclosure.

As illustrated in FIG. 8, equations previously disclosed herein may be used to configure the reflector 104, 106 to evenly illuminate an irregularly-shaped illumination surface 804; however, it should be noted that the illuminated strips defined by w by length l require an approximation of the width w such that the width w is assumed to be the shortest distance between the points $P_n$ and $P_{n-1}$.

As further illustrated in FIG. 8, a second reflector 106 may be provided, such that a first reflector 104 illuminates a first illumination region 804*a* of the irregular surface 804, and a second reflector 106 illuminates a second illumination region 804*b* of the irregular surface 804. To compensate for shadows that may be caused by the light source 102, the first and second reflectors 104, 106 may be configured to illuminate an overlapping region 804*c* of the irregular surface 804. The overlapping region 804*c* may be the region most proximal to the normal 204 of the light source 102. That is, the light source 102 may be an elongated light source and configured to direct light towards the reflectors 104, 106, and the reflectors 104, 106 may be configured to cause one or more rays of reflected light (e.g. Ray 3) to cross a plane defined by light emitted normal to the elongated light source 102 and a point on the x axis of the light source 102.

As illustrated in FIG. 8A, a reflector 106 for a light assembly 402 may be provided. The reflector 106 may include a series of curved segments $\mathbf{806}_1 \ldots \mathbf{806}_n$, one or more of which may include elliptical, parabolic, or other curved profiles defining respective reflective surface areas 308. Weighting factors previously described herein may be used to adjust the respective reflective areas 308 by adjusting respective lengths $L_1 \ldots L_n$ of the segments $\mathbf{806}_1 \ldots \mathbf{806}_n$. In some embodiments, the first and second focal points of a respective segment $\mathbf{806}_1 \ldots \mathbf{806}_n$ may be assumed to be the same where a distance h to an illuminated surface 206 is very large.

Figure 9:
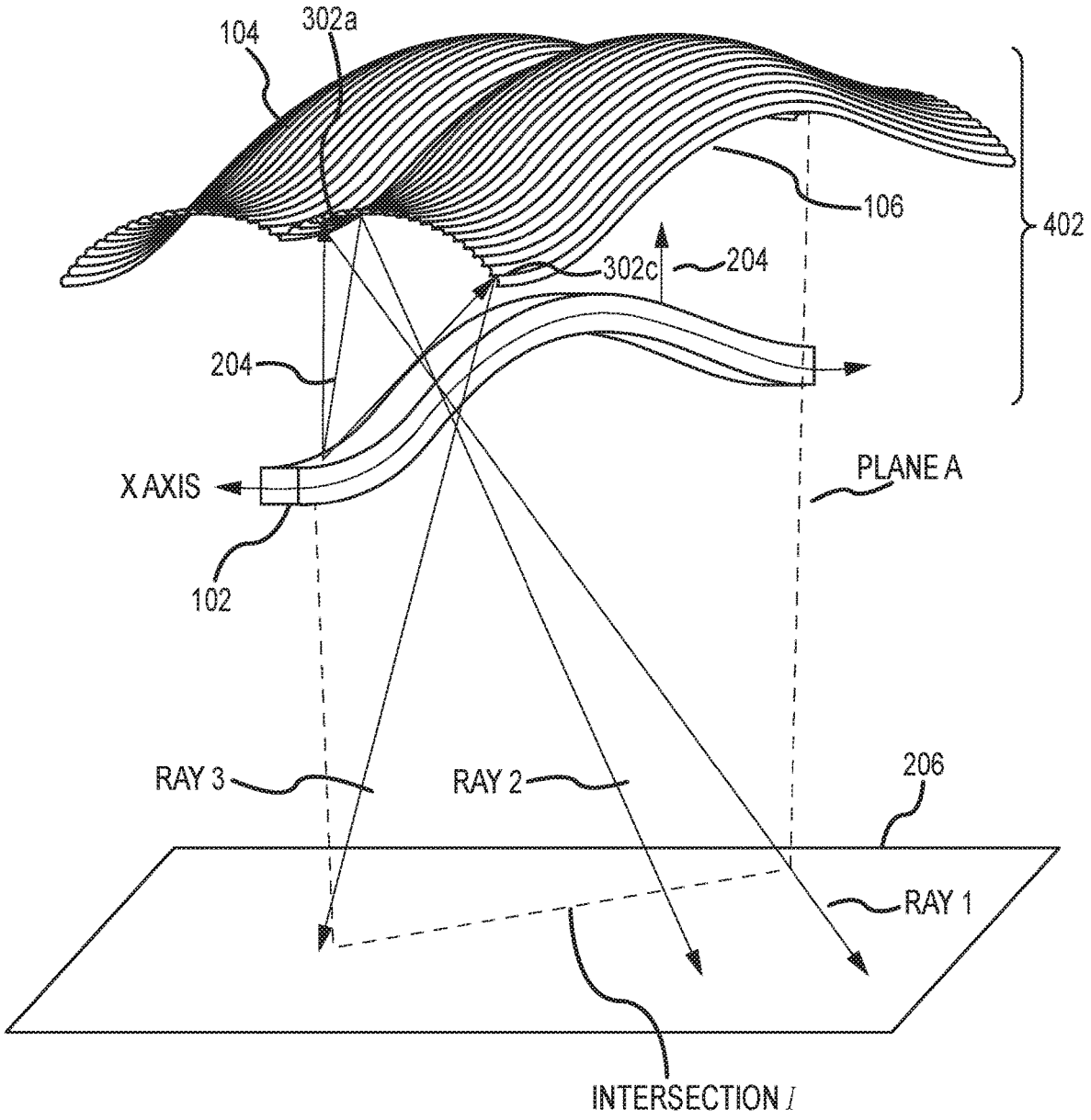
FIG. 9 is a side perspective view of a light assembly having a curved light source uniformly illuminating a flat target surface.

Turning now to FIG. 9, a light assembly 402 may be provided as previously described herein; however, the light source 102 may be elongated along an irregular x axis in a plane A that includes the x axis and intersects the illuminated surface 206. That is, while the x axis and light source 102 may define a plane A, the x axis may be curved within the plane A. Despite having an irregular x axis, the light assembly 402 may be configured to evenly or regularly illuminate a substantially flat, planar, or even illumination surface 206. As can be understood from FIG. 9, segments 302 of the reflector(s) 104, 106 should be adjusted not just according to the respective position relative to the extremities from the x axis, but also along the length l parallel to the x axis. As illustrated in FIG. 9, the reflectors 104, 106 may be configured such that a first light Ray 1 reflecting from an inner or proximal segment 302*a* may be directed towards a distal region of the illuminated surface, while a third light Ray 3 reflecting from an end segment or distal segment 302*c* may be directed to cross the plane A and illuminate a region of the illuminated surface 206 that would otherwise be shadowed by the light source 102. A second light ray Ray 2 may be reflected between the first and third rays.

In some embodiments, the reflector(s) 104, 106 may be texturized, so as to soften light reflections by providing a slightly irregular reflection of light rays (Ray 1-Ray 3) in addition to the controlled direction of the rays by the segments 302.

Figure 10:
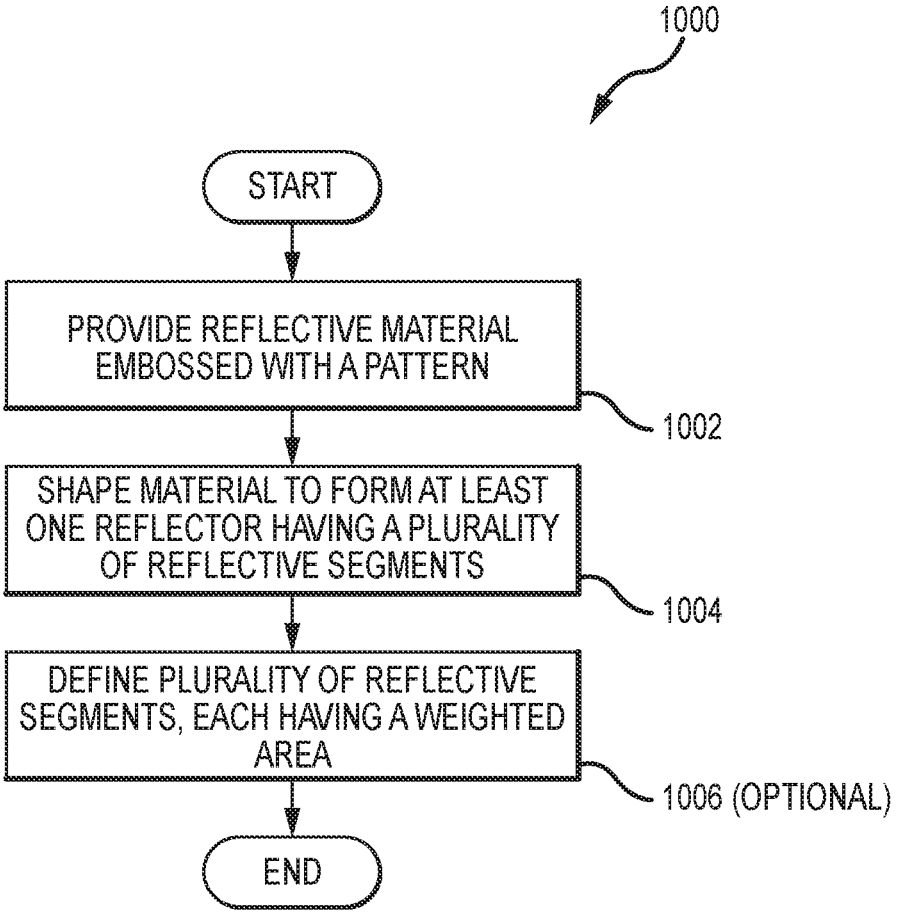
FIG. 10 is a flowchart of a method of illuminating a target surface.

Turning now to FIG. 10, a method 1000 of manufacturing a light reflector for a light assembly is herein described. The method 1000 includes providing 1002 a reflective material embossed with a pattern. Providing 1002 may include securing a blank sheet of malleable reflective material such as a metallic material, and roughening the malleable material to provide a slightly irregular or roughened surface. Roughening may include sand blasting, bead blasting, and/or shot blasting a surface of the malleable material, or any other roughening methods known or developed by those skilled in the art. The malleable material may be aluminum or another reflective material. In some embodiments, providing 1002 includes providing a malleable material that is not reflective, and coating the material with a reflective paint, such as a metallic paint, and roughening the painted surface or otherwise allowing or causing the painted surface to develop irregularities.

The method 1000 also includes shaping 1004 the malleable material to form at least one reflector having a plurality of reflective segments, wherein a focal point of a distal reflective segment crosses a focal point of a proximal reflective segment. Shaping 1004 may include pressing first through last reflective segments. Pressing may include adjusting a press surface and/or press pressure between one or more reflective segments. Pressing may include pressing a curved, elliptical, or parabolic profile into respective ones of the reflective segments.

Shaping 1004 may also include shaping a linear x axis or shaping a curved x axis of the reflector.

Shaping 1004 may also include adjusting a profile of one or more reflective profiles relative to a position of the respective reflective profile along a length l of the reflector.

In some embodiments, the method 1000 includes defining 1006 a plurality of reflective segments in the reflector, wherein each reflective segment has reflective surface area that is defined using a weighting factor. Defining 1006 may be accomplished using any of the equations or methods previously described herein. Defining 1006 may include adjusting or design a press to result in the reflective surfaces described herein.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. For example, while some embodiments of the invention have been described with respect to embodiments utilizing LEDs, light sources incorporating other types of light-emitting devices (including, e.g., laser, incandescent, fluorescent, halogen, or high-intensity discharge lights) may similarly achieve variable beam divergence if the drive currents to these devices are individually controlled in accordance with the concepts and methods disclosed herein. Accordingly, the described embodiments are to be considered in all respects as only illustrative and not restrictive.

Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of a "reflector" should be understood to encompass disclosure of the act of "reflecting"—whether explicitly discussed or not—and, conversely, were there only disclosure of the act of "reflecting", such a disclosure should be understood to encompass disclosure of a "reflecting mechanism". Such changes and alternative terms are to be understood to be explicitly included in the description.

The previous description of the disclosed embodiments and examples is provided to enable any person skilled in the art to make or use the present invention as defined by the claims. Thus, the present invention is not intended to be limited to the examples disclosed herein. Various modifications to these embodiments will be readily apparent to those skilled in the art, and the generic principles defined herein may be applied to other embodiments without departing from the spirit or scope of the invention as claimed.

The invention claimed is:

1. A device for substantially uniform illumination of a non-planar target surface, comprising:

an elongated light source extending along an x axis and arranged to prevent any direct impingement of light onto the non-planar target surface; and at least one reflector having a length relative to the x axis and a reflective surface area, the reflective surface area comprising a profile having a plurality of curved reflective segments;

wherein the non-planar target surface has a target surface area that is greater than the reflective surface area, wherein the at least one reflector subtends an angle of approximately 45° or less measured from a center of the elongated light source to an exterior edge of the at least one reflector;

the non-planar target surface has a first region and a second region, the first region comprising an intersection between the non-planar target surface and a normal of the light source, the second region being further from the intersection than the first region is;

a first of the curved reflective segments is configured to reflect light primarily to the second region of the non-planar target surface;

a second of the curved reflective segments is configured to reflect light primarily to the first region of the non-planar target surface, wherein the first and second curved reflective segments include a centrally joined portion;

the elongated light source and the at least one reflector are arranged such that the at least one reflector, by virtue of its shape, is configured to directly intercept and reflect a portion of light emitted by the light source to thereby cause said substantially uniform illumination of the non-planar target surface; and at least some of the light reflected by the first curved reflective segment, and the light reflected by the second curved reflective segment cross paths.

2. The device of claim 1, wherein the plurality of curved reflective surfaces comprise a shape of a plurality of elliptical segments each having a common focus coincident with the elongated light source and a second foci that is non-coincident with each other and distributed over the non-planar target surface.

3. The device of claim 2, wherein the second foci of the plurality of elliptical segments are substantially evenly distributed over the non-planar target surface, thereby configured to cause substantially uniform illumination of the non-planar target surface.

4. The device of claim 1, wherein:

the first curved reflective segment is configured to receive a first light having a first intensity from the elongated light source, and reflect the first light having the first intensity to a first spatial region, wherein the first spatial region is a first distance from the elongated light source;

and wherein the second curved reflective segment is configured to receive a second light having a second intensity from the elongated light source and reflect the second light having the second intensity to a second spatial region, wherein the second spatial region a second distance from the elongated light source, the second distance less than the first distance, and wherein the second intensity is lower than the first intensity, immediately before the first and second lights impinge upon the first and second reflective segments, respectively.

5. The device of claim 1, wherein the elongated light source is arranged along an optical axis of the at least one reflector.

6. The device of claim 1, further comprising an actuator to adjust a position of at least one curved reflective segment.

7. The device of claim 1, wherein the at least one reflector subtends an angle of approximately 90°, measured from a center of the elongated light source.

8. The device of claim 1, wherein the at least one reflector comprises two reflectors and the device further comprises an optical element placed between the two reflectors.

9. The device of claim 1, wherein the at least one reflector comprises a plurality of parabolic segments or a plurality of elliptical segments having a common focus coincident with the elongated light source.

10. The device of claim 9, wherein directing angles of the parabolic segments or elliptical segments are evenly distributed over the non-planar target surface.

11. The device of claim 1, wherein the at least one reflector and the elongated light source extend in a non-linear direction along the x axis.

12. A method for substantially uniform illumination of a non-planar target surface, comprising:

emitting light by an elongated light source, the elongated light source extending along an x axis and being arranged to prevent any direct impingement of light onto the non-planar target surface; and causing at least one reflector extending parallel to at least a portion of the elongated light source and having a plurality of curved reflective segments to directly intercept and reflect a portion of light emitted by the elongated light source, the at least one reflector having a reflective surface area;

causing a first curved reflective segment to reflect light to a second region of the non-planar target surface;

causing a second curved reflective segment to reflect light to a first region of the non-planar target surface;

causing the light reflected by the first curved reflective segment and the light reflected by the second curved reflective segment to cross paths; and effecting substantially uniform illumination of the non-planar target surface, the non-planar target surface having an area greater than the reflective surface area of the at least one reflector, wherein the first curved reflective segment and the second curved reflective segment comprise the shape of a plurality of elliptical segments, the plurality of elliptical segments having a common focus coincident with the light source and a different second foci distributed over the non-planar target surface.

13. A device assembly for substantially uniform illumination of an non-planar target surface, comprising:

a linear light source configured to be coupled to a mounting surface and arranged to prevent any direct impingement of light onto the non-planar target surface; and at least one reflector configured to be coupled to at least one of the light source or the mounting surface, and interposed between the light source and the mounting surface, the at least one reflector having a reflective surface area, the at least one reflector comprising a plurality of curved reflective segments, wherein the at least one reflector subtends an angle of approximately 45° or less, measured from a center of the elongated light source to an exterior edge of the at least one reflector, and wherein the plurality of curved reflective segments including a centrally joined portion;

wherein the at least one reflector is shaped and arranged relative to the light source such that the at least one reflector intercepts and reflects a portion of light emitted by the light source to the non-planar target surface to thereby cause substantially uniform illumination of the non-planar target surface; and wherein the non-planar target surface has a surface area that is greater than the reflective surface area of the at least one reflector.

14. The device assembly of claim 13, wherein the first curved reflective segment and the second curved reflective segment comprise the shape of a first elliptical segment and a second elliptical segment, respectively;

wherein the first elliptical segment is configured to receive a first light having a first intensity from the light source and reflect the first light having the first intensity to a first spatial region of the non-planar target surface, wherein the first spatial region a first distance from the light source;

and wherein the second elliptical segment is configured to receive a second light having a second intensity from the second light source and reflect the second light having the second intensity to a second spatial region of the non-planar target surface, wherein the second spatial region a second distance from the light source, wherein the second distance is less than the first distance, and wherein the second intensity being lower than the first intensity, immediately before the first and second lights impinge upon the first and second elliptical segments, respectively.

15. The device assembly of claim 13; wherein the surf ace area of the non-planar target surf ace is at least an order of magnitude greater than the reflective surface area.

16. The device assembly of claim 13; wherein a first one of the plurality of reflective segments is configured to receive a second light having a first intensity from the light source;

a second one of the plurality of reflective segments is configured to receive said second light having a second intensity from the light source, the second intensity less than the first intensity;

the first one of the plurality of reflective segments is configured to transform the light having the first intensity into a first reflected light having a third intensity; and the second one of the plurality of reflective segments is configured to transform the light having the second intensity into a second reflected light having the third intensity.

* * * * *